US011608573B2

(12) United States Patent
Marin

(10) Patent No.: US 11,608,573 B2
(45) Date of Patent: Mar. 21, 2023

(54) PRODUCTION PROCESS OF CIRCULAR AND SUSTAINABLE MIXED YARNS AND MIXED YARNS OBTAINED

(71) Applicant: Antonio Herminio Marin, Cotia (BR)

(72) Inventor: Antonio Herminio Marin, Cotia (BR)

( * ) Notice: Subject to any disclaimer, the term of this patent is extended or adjusted under 35 U.S.C. 154(b) by 0 days.

(21) Appl. No.: 17/139,162

(22) Filed: Dec. 31, 2020

(65) Prior Publication Data

US 2021/0130988 A1 May 6, 2021

Related U.S. Application Data

(63) Continuation-in-part of application No. 16/889,014, filed on Jun. 1, 2020, now abandoned.

(30) Foreign Application Priority Data

Jun. 17, 2019 (BR) ..... 10 2019 012508 0

(51) Int. Cl.
*D02G 3/04* (2006.01)
*D02G 3/22* (2006.01)
*D02G 3/28* (2006.01)

(52) U.S. Cl.
CPC ..... *D02G 3/04* (2013.01); *D02G 3/22* (2013.01); *D02G 3/28* (2013.01); *D10B 2201/02* (2013.01);

(Continued)

(58) Field of Classification Search
CPC .. D02G 3/02; D02G 3/04; D02G 3/22; D02G 3/28; D02J 1/00; D02J 1/08; D02J 7/00
See application file for complete search history.

(56) References Cited

U.S. PATENT DOCUMENTS 4,685,179 A * 8/1987 Sheehan ..... D02G 1/161 28/248
4,782,565 A * 11/1988 Sheehan ..... D02G 1/161 28/248

(Continued)

FOREIGN PATENT DOCUMENTS

EP 0161572 A1 * 11/1985 ..... D02G 3/328
JP 08060493 A * 3/1996
WO WO-2008092220 A1 * 8/2008 ..... D02J 1/08

*Primary Examiner* — Shaun R Hurley
(74) *Attorney, Agent, or Firm* — B. Aaron Schulman, Esq.; Stites & Harbison, PLLC

(57) ABSTRACT

A production process of mixed yarns and mixed yarns obtained from circular and or sustainable and or biodegradable textiles within any textile industry and or adapted in the machines within spinning mills. This makes possible a very large combination of different types of textile yarn mixtures and a wide range of weights of mixed sustainable and or biodegradable yarns, to meet and create new demands for sustainable and circular textile products. The process described for injection of compressed air is the combination and mixing of sustainable and circular and or biodegradable continuous filament yarns with biodegradable, and sustainable natural and/or artificial spun yarns, bringing technology to the products in line with the sustainability of the environment. This makes possible a definitive solution in ocean contamination by synthetic fibers and prevents much of the artificial textile fibers from fabrics and clothes, which release their cut fibers during industrial and domestic washing.

9 Claims, 4 Drawing Sheets

(52) U.S. Cl.
CPC ..... *D10B 2201/24* (2013.01); *D10B 2331/04* (2013.01); *D10B 2401/12* (2013.01)

(56) References Cited

U.S. PATENT DOCUMENTS

| | | | | | |
|---|---|---|---|---|---|
| 5,014,404 | A * | 5/1991 | Smith | D02G 1/165 | 28/271 |
| 5,279,629 | A * | 1/1994 | Stueble | B01D 46/12 | 55/323 |
| 5,317,791 | A * | 6/1994 | Adam | D01H 13/04 | 28/252 |
| 5,336,285 | A * | 8/1994 | Grandek | B65H 54/702 | 55/324 |
| 5,680,684 | A * | 10/1997 | Musha | D02J 1/08 | 28/271 |
| 5,773,555 | A * | 6/1998 | Weger | C08G 69/28 | 528/310 |
| 6,221,121 | B1 * | 4/2001 | Schelter | D01H 11/005 | 15/352 |
| 2006/0201129 | A1 * | 9/2006 | Bumgardner | D02J 1/08 | 57/225 |
| 2007/0107410 | A1 * | 5/2007 | Bertsch | D02J 1/08 | 57/350 |
| 2009/0013662 | A1 * | 1/2009 | Uemura | D02J 1/08 | 57/238 |
| 2016/0010246 | A1 * | 1/2016 | Nakai | D02G 3/402 | 57/244 |
| 2016/0244911 | A1 * | 8/2016 | Kelly | D06P 5/2055 | |

* cited by examiner

PRODUCTION PROCESS OF CIRCULAR AND SUSTAINABLE MIXED YARNS AND MIXED YARNS OBTAINED

CROSS REFERENCE TO RELATED APPLICATION

This application is a continuation-in-part application and takes priority from and claims the benefit of U.S. patent application Ser. No. 16/889,014 filed on Jun. 1, 2020, which in turn claims priority to and takes the benefit of Brazilian Patent Application No. BR 10 2019 012508 0 filed on Jun. 17, 2019, the contents of which are herein incorporated by reference.

BACKGROUND OF THE INVENTION

Field of the Invention

The present invention refers to a production process of mixed yarns and mixed yarns obtained from circular and sustainable and/or biodegradable textiles within textile industries and/or adapted in the machines inside spinning mills. This invention allows a very large combination of different types of mixed yarn and a wide range of weights and composition of mixed sustainable and circular and or biodegradable yarns, to meet and create new demands for sustainable textile products.

Description of the Related Art

This sustainable and circular process and product uses in its mixture sustainable and circular and/or biodegradable spun yarn and sustainable and/or circular continuous filament and/or biodegradable continuous filament, from the interlacing of the yarns mentioned in the claims, based on the injection of compressed air, adding improvements to the production of a sustainable and circular mixed yarn in great demand, with greater durability, resulting in clothing and/or knits and/or fabrics with extreme quality, durability, circularity, and dimensional structure, making it possible to bring advanced technology from continuous filaments to spun yarns, thus meeting the new technical need of the sustainability and circular textile market, helping an exponential financial economy, protecting and taking care of the environment, waters, oceans and all animals on planet Earth. This process is called the evolution of the intimate mixture "Clean Ocean".

As is already known, sustainable and circular and or biodegradable fabric and clothing are essential materials in the current moment of the modern textile industry.

The need and duty to protect the environment from the flow of polluting raw materials within the complex textile chain. As the second most polluting industry on the planet, the textile industry has a duty to find, execute and put into practice solutions in processes, and sustainable, circular, biodegradable products, to be integrated in their production and in the global textile market.

Organic cotton from the Better Cotton Initiative (BCI), a non-profit organization, created in 2005, based in Geneva, Switzerland, which works to improve world cotton production for those who produce it, is a very questioned product by environmentalists for requiring large farming spaces, but on the other hand it is a sustainable natural yarn, consumes less water, requires little to no pesticides, has re-management of cultivated area, is a comfortable product, and has more workers involved and its cultivation, having a very important role in the socioeconomic view.

Viscose, lyocell, bamboo and rayon are artificial spun yarns and continuous filaments produced in a closed-loop production chain of their fiber, making them a highly circular, sustainable and biodegradable product, excellent comfortable yarns for modern textile use, preferably where its raw material was made in a closed loop chain, where all the waste from the process is captured and transformed into a by-product to be reused, creating a sustainable and circular life cycle.

The linen and hemp yarns come from a natural fiber that brings comfort, versatility and durability. From its planting to the preparation of the fiber and the final finish of the fabric, the impacts on the environment are minimal. Its cultivation requires up to twenty times less water than cotton and minimal amounts of fertilizer, in addition, flax and hemp does not harm the soil, being easily incorporated into the rotation cycle of other crops, the processing of its fibers is done with low use of electricity and relies on with the help of natural agents, such as rain and sun, no pesticide use and practically all residues from its production are used by other industries, such as cosmetics, food and paper.

Modern high-tech continuous filaments have molecules with nanotechnology for protection from ultraviolet rays, among others, and are also sustainable and circular and/or biodegradable from their initial process to the final life cycle. Preferably used in mixed yarns combining cutting-edge technology with the oldest industry in the world, spun yarn spinning.

The lactic polyacid plastic filament, which is a continuous filament made from maize leaves, is a raw material that consumes very little water, grows along with the maize and does not cause cultivation competition, meeting food and clothing needs in a single space of cultivation, characteristics and trends very important for our future. An excellent attraction is that lactic polyacid plastic can be molecularly mixed with another raw material, the polyethylene terephthalate or polyester, in its composition, thus making semi-sustainable yarns as the multi-component yarn in which different polymers are brought together in a single filament (50% recycled polyethylene terephthalate+18% lactic polyacid plastic+32% polyethylene terephthalate) or other compositions; the polyester continuous filament can be used in this situation as a middle ground of the economic and social textile sustainable beginner market, somewhere between yarn of petroleum raw material and yarn of natural raw material, to create a sustainable and circular textile market, leading to a future product using 100% chemical recycled yarns and or biodegradable yarns, a process and product of the new social economic closed loop textile market chain.

The Filament bio-raw material from nature is starting in the market right now, with low production and expensive. The raw material is: microbial cellulose, polyhydroxyalkanoate (PHA), cow manure cellulose, mushroom mycelium, animal Protein cellulose, vegetal and fruit Protein cellulose, lactic polyacid plastic. This bio-raw material from nature is not biodegradable in salt water and oceans and instead they just break down.

When mentioned in the present application, the items below mean: spun yarn: any natural fiber or artificial fiber, grouped fiber by fiber by various means of process, such as: conventional and by rotor, by air vortex, to form a yarn of grouped and twisted fibers, like for example: cotton, viscose, hemp, linen, among others; continuous filament yarn: any synthetic or artificial yarn that, from a chemical mass from oil and or organic nature raw material, undergoes an extrusion that forms a continuous filament yarn (polyester, lactic polyacid plastic, polyimide, Rayon, microbial cellulose, polyhydroxyalkanoate (PHA), cow manure cellulose, mushroom mycelium, animal Protein cellulose, vegetal and fruit Protein cellulose); mixed yarns: yarns with interlace points resulting from the compressed air interlacement process between one or more continuous filament yarns with one or more natural and or artificial spun yarns; textile industries: refers to industries that contain the entire vertical chain process inside (spinning, and/or winding, and/or weaving, and/or chemical finishing of fabrics or yarn and/or confection); conventional spinning process: refers to the process used in conventional spinning (carded yarns and combed yarns from ring spun process); unconventional spinning process: refers to the process used in unconventional spinning (by rotor, by air vortex); intimate mixing: any spun yarn that has an intimate mixing process to mix synthetic or artificial and or natural cut fibers with each other, using a large amount of energy, no stop production, and limited to the manufacture of a large amount of just one kind of yarn; continuous filament spinning: spinning yarn that has a vertical process with the introduction of chemicals, until the manufacture of the final continuous filament yarn, using a large amount of energy, and limited to the manufacture of yarn in large quantity; knitted fabric: type of knitwear fabric produced on a large scale using circular looms; chemical finishing of fabrics: process to fix and size the fabric and give it a more pleasant touch; injector nozzle: compressed air equipment that performs the function of interlacing the yarns; porcelain insert: inserted in the injector nozzle, with several types to be chosen for a specific technical function, depending on the characteristics needed for the ready mixed yarn, having various sizes and orifice shapes, creating the tangle of the yarns with interlace points; oligomer: polyester chain molecules of continuous filaments that have not settled in their manufacturing process or water dye process, usually low and medium quality yarns; collector of oligomers and fibers: box that surrounds the air nozzles protecting employees and collecting oligomer and fibers residues; durable: high quality yarns, fabrics and clothing for a longer life cycle use; mixed blend: mixture of natural and artificial spun yarn with a filament, each of a different color, giving a blend effect to the fabric; bus in textile fabric: existing defect in knits and fabric due to a yarn problem, usually in blends; plastic micro particles: small fibers of synthetic from cut fiber yarns, which come out of fabrics or clothes during washing, using and pollute the oceans; sustainable: product with a clean production chain and a complete life cycle use, without damaging the environment and with a good socio-economic life cycle; biodegradable: product or raw material completely break down and decompose by living organism without contamination; compostable: product or raw material that gives energy to other living organism to transform the material; circular: any product that does not interfere or harm the health and well-being of the environmental, having a long life cycle and closed loop synthetic fibers; lactic polyacid plastic: is a continuous filament made from maize leaves, which is a raw material that consumes very little water; semi-recycled(multi-component): original raw material polyethylene terephthalate and also lactic polyacid plastic raw material, mixed with raw material from polyethylene terephthalate bottles are two-component filaments from two filament chains of molecules on the same yarn(bi-component), where part of the material is recycled and part of the material is virgin; recycled polyethylene terephthalate: all recycled polyethylene terephthalate bottle yarn; chemical recycled: to melt down clothes and fabrics, to be able chemically separate raw material to re-process in textile or another type of industry. Separately, others cut fibers: use this fiber to make spun yarn by renewable raw material source of nature (microbial cellulose, polyhydroxyalkanoate (PHA), cow manure cellulose, mushroom mycelium, animal Protein cellulose, vegetal and fruit Protein cellulose, lactic polyacid plastic), it is biodegradable just in soil; Filament bio-raw material from nature: is renewable raw material source of nature. Could be: microbial cellulose, polyhydroxyalkanoate (PHA), cow manure cellulose, mushroom mycelium, animal Protein cellulose, vegetal and fruit Protein cellulose, lactic polyacid plastic or others elements from nature.

Currently, several types of yarn production—yarn spinning—are available on the market. The textile yarn is the final product of the spinning stage, its main characteristic being the diameter or thickness (technically called the count yarn); the textile yarn can be manufactured from natural, artificial and synthetic fibers, which is currently the raw material used.

The production process of circular and sustainable mixed yarns aims to place a differentiated product on the market, with a high added value in sustainability, since the process referred to here is not polluting, as a collector of oligomers and other molecules and fibers that come off the process was developed.

The productive capacity of a spinning mill is determined by the types of processes used and market consumption. There are three basic types, distinguished by the speed of production, limited count yarn, in some processes there is a lower yarn elongation and wide variation in levels of automation reached and the quality and thickness of the yarn produced, which are: the conventional process (ring spinning machine) and the unconventional process by air vortex and rotor.

The patent PI0704157-8 deals with a process of manufacturing mixed yarns at a low production scale, a polluting process in oligomers and other diverse molecules and fibers with different machine speeds, compressed air pressures, and with little amplitude, thus hampering the manufacture of new mixed yarns and utilizing a lot of energy in compressed air with the mentioned high pressures. The process does not produce large volumes. The process is not prepared to use biodegradable yarns. The process does not process spin natural and artificial raw material fiber. The process must buy the spun yarn to make the mixed yarns. The process contaminates the environment without the collector (5), making it impossible to substitute the intimate mixture, as it does not reach the spinning mills producing the intimate fiber and as well contaminating the environment without the collector (5), harming a global change of sustainable consciousness. While the patent application described here allows for a large volume of different types of mixtures and diversified count yarn without altering the initial spinning process, in addition to providing a wide variety of circular and sustainable and or biodegradable continuous filament yarns combined with circular and sustainable and/or biodegradable natural and/or artificial spun yarns in the end of the spinning process, providing greater durability, circularity, comfort, and structural dimensioning of the manufactured piece, thus enabling the replacement of the intimate mixture coupled inside spinning machines or produced in textile industries.

SUMMARY OF THE INVENTION

The sustainable product and process, described here, coupled inside the spinning machines or produced in textile industry, does not contain synthetic cut fiber of polyester and polyamide in the mixed yarn, one of the biggest causes of ocean and Earth contamination by plastic microparticles and cut fibers, which currently triggers an unprecedented contamination affecting the entire human food chain. Instead, it uses sustainable and circular and or biodegradable synthetic filament, replacing the synthetic cut fiber of polyester and polyamide creating, protecting and giving more comfort, durability and circularity to clothes for society with a real circular and sustainable "Clean Ocean" mixed yarn process and products.

Another objective was to provide a mixed yarn production process that preferably uses biodegradable continuous filaments and/or circular and sustainable continuous filaments that can be dyed in their mass, eliminating water bath dyeing, making it less polluting and using less water in the dyeing process of the fabrics, in addition, the mixed yarn leaves the process ready, without the need for bath dyeing, only finishing for some kinds of final yarn combinations for a visual effect product.

Another objective of providing a mixed yarn production process is to enable a range of weights, count yarn, composition, speed to change, on demand production of sustainable and circular and or biodegradable mixed yarns, with a possibility, of more than eight yarns simultaneously entering the process forming a single mixed yarn without interrupting the natural or artificial spun yarn spinning process on.

Another objective was to provide a mixed yarn process for the production of circular and sustainable and or biodegradable mixed yarns.

Another objective was to provide a mixed yarn production process that makes it possible to combine spun yarns of 100% organic cotton with biodegradable and/or circular and sustainable and technological continuous filaments, and or polyester (circular continuous filaments), in the percentage of local federal law and thus defined as an organic product.

Another objective of providing a mixed yarn production process is that the production process for mixed, circular and sustainable and or biodegradable yarns is a sustainable process, in combining mixed yarns by compressed air, ensuring the adequate removal and disposal of existing oligomer molecules, other molecules and other fibers during the process, thus avoiding soil and environmental contamination and risk to respiratory health.

Another objective was to provide a production process for mixed yarns that enables easy adaptation of the process in the spinning mills, packing bobbins or textile industries. Mixed biodegradable and or sustainable and circular yarns are used in conventional and unconventional process machinery connected to other machines or not coupled inside the spinning machines or produced in textile industries.

The objectives and advantages of the present process are achieved through new pressures of compressed air, making possible use of the minimum pressure of compressed air, saving energy exerted on and around the spun yarns, at the moment of passing through the injector nozzle, creating a tangle of filaments around it and interlacing points on them. The new porcelain inserts have a different size and shape of the orifice that is fitted in the nozzle injector, meaning that there is no need to change the nozzle, obtaining a wide effect of mixed blends in circular and sustainable and or biodegradable yarn. The new circular, recycled and/or biodegradable continuous filament is mixed with the natural and or artificial spun yarn made in the spinning process and packing bobbin in textile industries. The new mixed yarn process to save the ocean from synthetics cut fibers.

DETAILED DESCRIPTION OF THE SEVERAL EMBODIMENTS

Figure 1:
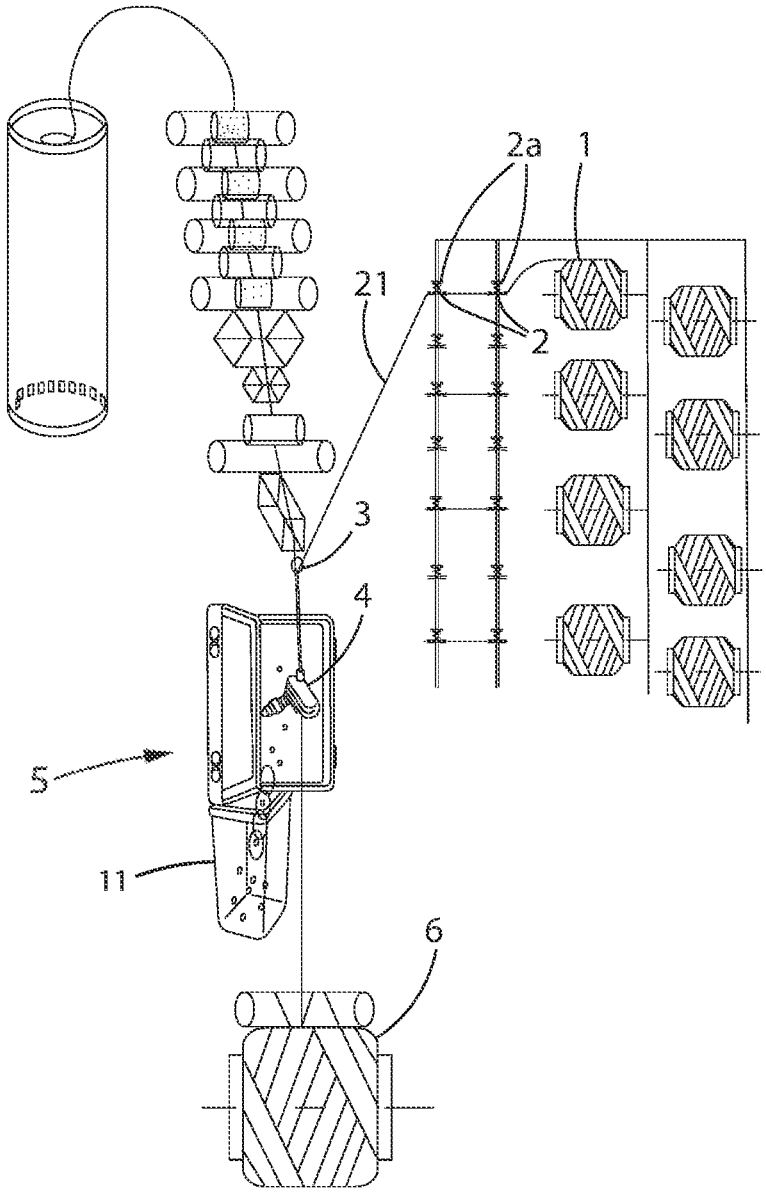
FIG. 1 is a schematic diagram showing a process of producing circular and sustainable mixed yarns adapted in a vortex machine.

Reference will now be made to non-limiting embodiments, examples of which are illustrated in the figures. FIG. 1-4 show the steps of producing Clean Ocean mixed yarns adapted in a vortex, rotor, ring spun, winding packing bobbin yarn by first placing the continuous filaments and/or the spun yarns in a number of bobbin supports to be mixed with the yarn from and during process of vortex, rotor, ring spun, packing bobbin machine 1. Then, placing the continuous filaments and/or the spun yarns through the tensioners 2, the yarn guides 3, the air injector nozzle 4, the collector 5 which includes a protector 11 attached, and the mixed yarn winding packing bobbin 6.

The inventive process can be coupled to an existing machine in the spinning mills including conventional rotor and air vortex, open end, ring spun and in textile industries packing bobbin machine to produce a more durable mixed yarn with more circularity of all raw material and resistance to elongation which also can be 100% biodegradable, no pollution of synthetic cut fibers, and less pollution of spun yarn from natural and artificial fibers during normal use and washing clothes.

In step (1), a number of continuous filaments are placed in the bobbin supports while other bobbin supports can have natural and or artificial spun yarns too, which can be adapted to conventional and non-conventional spinning machines, interconnected or not, and in a packing bobbin machine.

FIG. 1 shows that in some embodiments, the inventive process is coupled to a vortex machine where silver 8 goes through drafting device 7, front roller nip 9, and vortex nozzle 10 before being mixed with a number of continuous filaments 21. Continuous filaments 21 are placed in a number of bobbin supports 20*a*-20*d* of a packing bobbin machine 1 while other bobbin supports can have natural and or artificial spun yarns.

Figure 2:
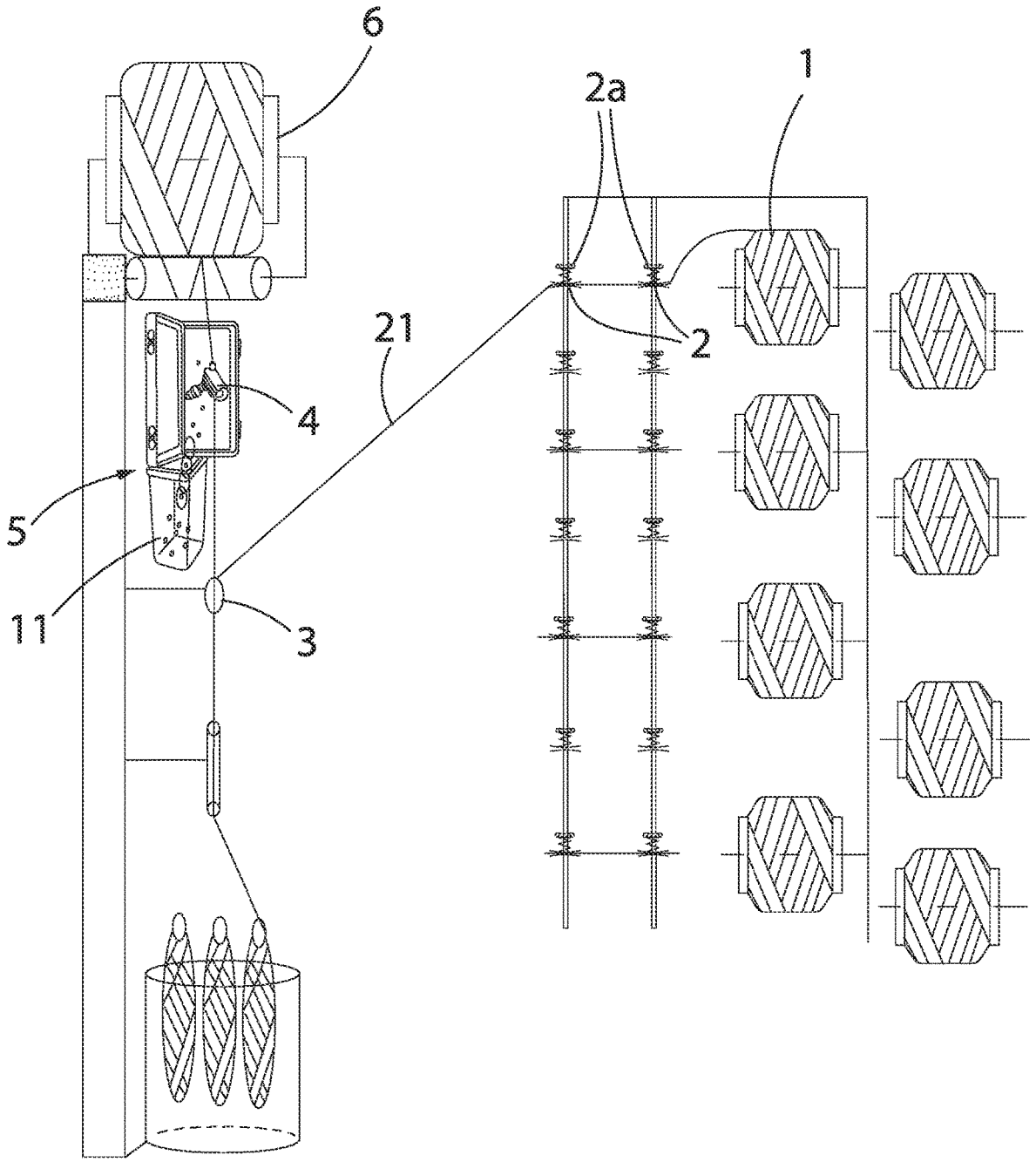
FIG. 2 is a schematic diagram showing a process of producing circular and sustainable mixed yarns adapted to a ring yarn (combed or carded) machine.
Figure 3:
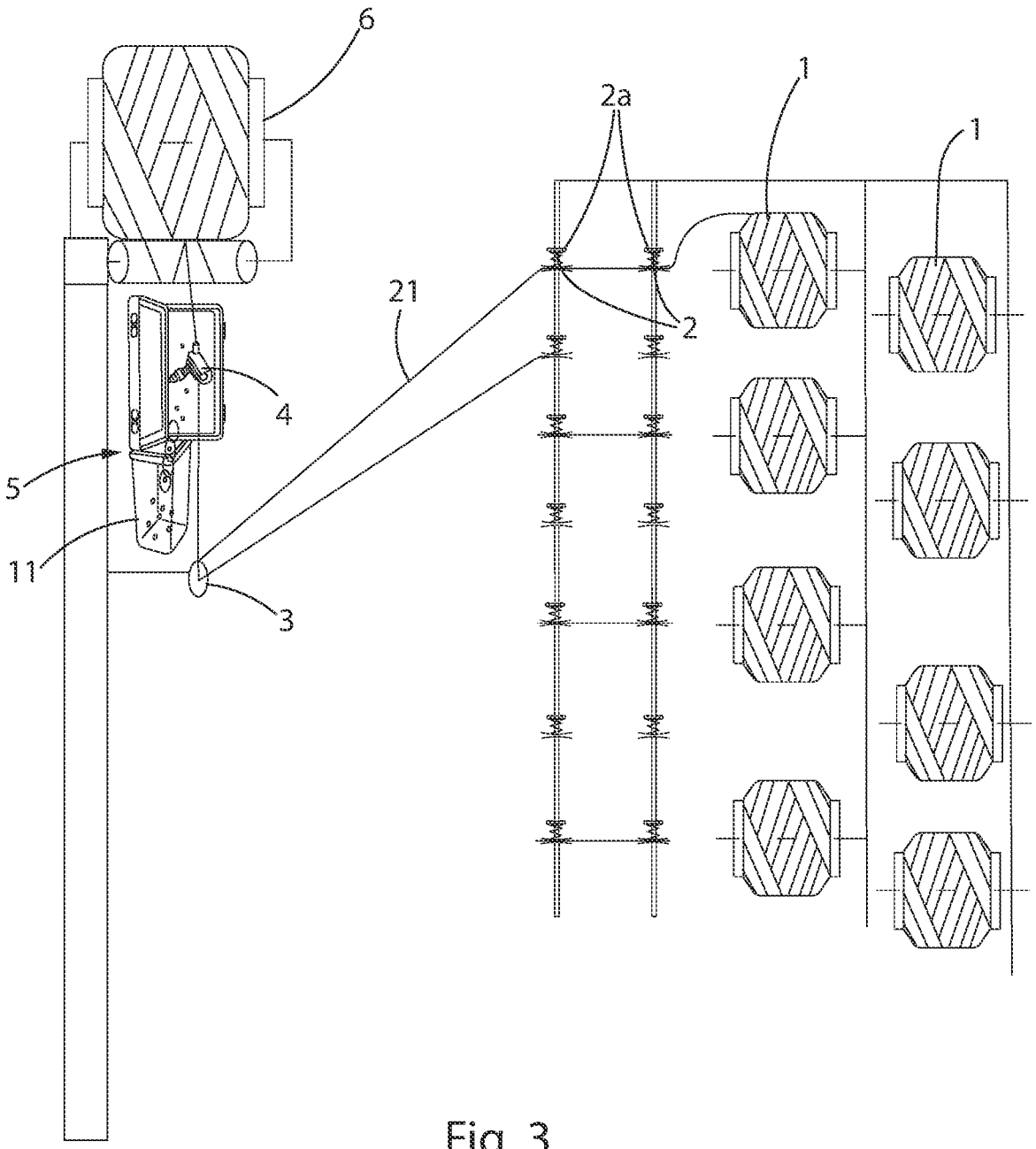
FIG. 3 is a schematic diagram showing a process of producing circular and sustainable mixed yarns adapted in a packing bobbin machines near to vortex, rotor, and ring yarns process machines.
Figure 4:
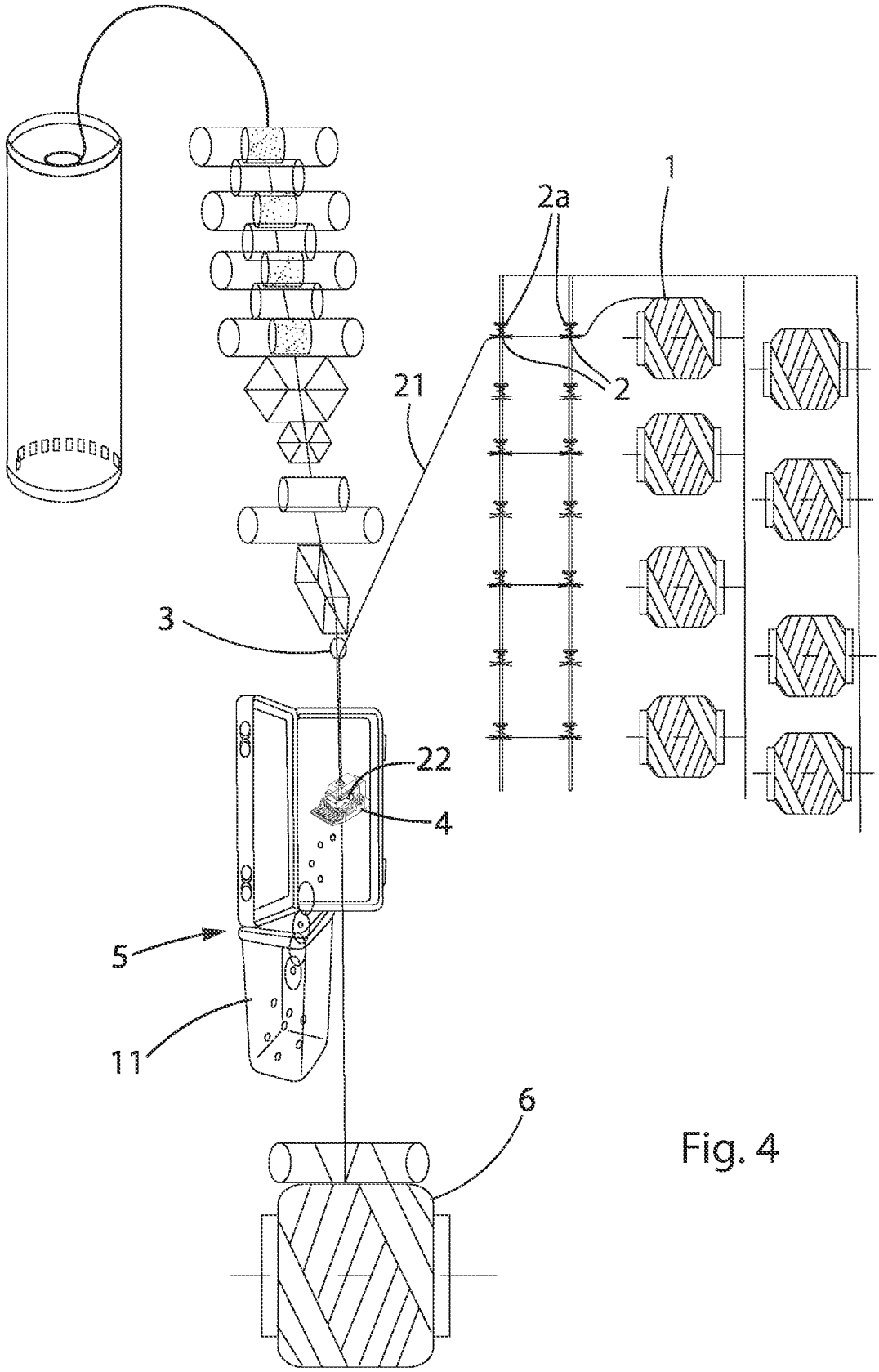
FIG. 4 is a schematic diagram showing a process of producing circular and sustainable mixed yarns adapted in an open-ended machine.

FIG. 2 shows that in some embodiments, the inventive process is coupled to a yarn clearing 14, ring spun bobbin 15 and a spindle container 16 in a ring yarn machine.

The number of spun yarns and continuous filaments is determined based on the specific needs to form a mixed yarn. The process can use any filament numbers of synthetics yarn and or biodegradable yarn to mix with any kind of artificial or natural spun yarn that are going in the process rotor, air vortex, open end, ring spun and/or placed in the bobbin supports in a packing bobbin machine. However, at least one filament yarn, sustainable and circular and or biodegradable must be selected.

The spun yarns of bobbin supports and or the spun yarn doing in the process of spinning rotor, air vortex, open end, ring spun, of step (1) are preferably selected from the group consisting of cotton from the Better Cotton Initiative (BCI), organic cotton, biodegradable viscose, biodegradable lyocell, and biodegradable linen, biodegradable hemp and any renewable biodegradable fiber raw material source of nature, which have higher returns of the raw material for reprocessing of clothing without contaminating the environment including landfills, and soil.

The natural or artificial spun yarn is homogeneous fibers grouped, aligned, and twisted to form a yarn. Each natural and artificial spun yarn has its characteristics defined by the size of its fibers and raw material used. The larger the fiber, the greater its resistance to breakage and elongation, and the softer the touch.

In addition, different machine processes such as vortex, open end, and ring spun also give different yarns in resistance, elongation, and touch.

The continuous filaments of step (1) are preferably a virgin and/or recycled and/or semi-recycled polyethylene terephthalate, polyester, polyamide, biodegradable lactic polyacid plastic and or biodegradable polyamide and or biodegradable lyocell and/or biodegradable rayon, microbial cellulose, polyhydroxyalkanoate (PHA), cow manure cellulose, mushroom mycelium, animal Protein cellulose, vegetal and fruit Protein cellulose and any other biodegradable filament and circular filament.

Additionally, the characteristics of the biodegradable and circular interlaced filament protects the fibers of the spun yarns from loosening. The natural and artificial spun yarn protects the biodegradable and/or circular filament from friction between the filaments. Thus, the process produces a more durable yarn and circular raw materials.

In step (2), the yarns pass through the tensioners 2, which is composed of two spring-loaded washers manually regulated by a wing nut 2*a*. The specific tension of the tensioner applied at the moment of the passage of the yarn may vary according to the elongation of each yarn. After inserting the yarn into tensioner, the wing nut is rotated to create a friction pressure. (See Table 1). The yarn is then placed in yarn guide 3, before entering air injector nozzle 4, collector 5, and the mixed yarn winding packing bobbin 6.

In some embodiments, air injector nozzle 4 is placed inside collector 5 to prevent the loosely attached filament molecules and fibers from spun yarn from breaking loose.

TABLE 1

| Material | Degree of Rotation |
|---|---|
| Natural and artificial spun yarn | 360 |
| Polyester | 540 |
| PLA and others filaments from renewable raw material | 630 |
| Polyamide | 630 |
| Polyamide biodegradable | 675 |

In some embodiments, an automatic yarn feeder tensioner is used for grouping yarns with different physical stretching characteristics given a push velocity and perfect continuo tension to produce a good bobbin tension yarn and good interlaced points on the mixed yarn, before entering the passage inside the air injection nozzle in parallel, making a perfect interlacing between the biodegradable filament and/or recycled synthetic filament and/or circular synthetic filament with the natural and/or artificial spun yarn. Tensioner variations can change the effect to the final mixed yarn in terms of volume, touch, interlaced points and the packing bobbin.

Therefore, prior to any adjustments on a tensioner, a technical specification from each manufacturer regarding the resistance to breakage and its elongation must be obtained through a rupture test on a dynamometer with a minimum variation.

In step (3), yarn guide 3 guides each yarn 30 from the bobbin and or the yarn from the spinning machine and packing bobbin machine, in parallel, to enter the injection nozzle in step (4).

In step (4) the continuous filaments create points of physical interlace points connections with the natural and/or artificial spun yarn by consequence of the whirlwind of compressed air, preferably from 0.3 to 6 Bar, inside injector nozzle 4, which adds a streaky visual effect to the fabric for making clothes and allows for less points of interlacing.

In some embodiments, inserts 22 made of porcelain, which may vary from more open or closed or oval or round orifice, are placed in injector nozzle 4, thus allowing different interlaced points on the yarn, keeping the points firm, durable, and with mixed blend variations, with these properties remaining even after fabric and garment manufacturing.

The durability of clothes is tested through washing in labs with high prevention of microfiber shedding, because the continuous filament creates strong interlacing points. These firm points between the spun yarns and continuous filaments allow the spun fibers to remain firmly attached and consequently, the spun fibers protect the continuous filaments from excessive friction between the filaments. As a result, the clothes are more durable, circular and they do not contaminate the environment with synthetic cut fibers.

In step (5), the most important of this process, a collector 5 of oligomers is placed. The main purpose of a collector is to collect oligomer molecules, which are generally loosely fixed and poorly washed molecules in the process of dyeing polyester or polyethylene terephthalate or other continuous filament molecules, described in step (1) and the spun yarn fibers described in step (1).

All yarns used in textiles for clothing may be dyed using less water. Preferably use the yarn filaments dyed in their primary form before extrusion during resin phase.

In addition, the combination of the mixed yarns is processed via compressed air to ensure adequate removal and disposal of the existing oligomer molecules and other molecules and fibers in the process. When passing the yarn through an air nozzle, the compressed air produces violent friction on the yarn where the chains of loosely attached filament molecules and fibers from spun yarn naturally break loose and can be released into the environment, most of the pollution of the synthetic cut fibers comes from the manufacture. Thus, the collector functions to capture these chains of loosely attached filament molecules and spun yarn fiber. It does not allow these fiber and molecules to scatter into air, soil, and water. At each stop of change of the mixed bobbin yarn, the collector could be removed for cleaning and disposing the filament molecules and fibers in a proper container if is necessary in the process.

Further, depending on the setting to decrease pressure of compressed air inside the internal passage of the air nozzle, lower air pressure is possible to obtain fewer points of interlacing. It is also possible that fewer interlacing points will occur between the yarn per linear meter and, yielding a final visual differentiation of the mixed yarns, which leads to less energy consumption when generating compressed air in the production line.

Therefore, the inventive process and product is sustainable and eco-friendly which replaces conventional process using intimate blended fiber by avoiding significant contamination of soil, air, and the ocean caused by cutting synthetic fibers from intimate blended fiber. Further, the process also reduces the risk to users with respiratory health issues.

In step (6), the winding packing bobbin machine 6 could be interconnected or not to another machine manually or automatically in preparation of mixed yarn conical reel. The speed varies according to its machine model.

In some embodiments, the mixed yarn winding packing bobbin 6 is coupled to a grove bakelite drum 12.

As shown herein, a process to produce circular and sustainable and or biodegradable mixed yarns, which is eco-friendly by replacing intimate blended fiber of cut synthetic fibers are disclosed. In some embodiment, the process uses biodegradable continuous filament, circular and/or sustainable and/or recycled and/or virgin synthetic continuous filament. Based on the above and illustrated, the present invention deals with mixed yarns mixed by compressed air, which are used in machinery of the conventional and unconventional spinning process, whether or not interconnected to other machines or produced in winding packing bobbin machines near to the spinning process within the textile industries, with characteristics of novelty, inventive step and industrial application, fundamental for patenting, with claims described below.

What is claimed is:

1. A method of producing a biodegradable and recyclable mixed yarn, the method comprising:

placing at least one continuous filament in a bobbin support;

placing the at least one continuous filament through a pair of tensioners, each tensioner in said pair of tensioners comprised of two-spring-loaded washers regulated by wing nuts, wherein the wing nuts are automatically or manually rotated to create a tension in order to regulate the entrance tension of the continuous filament;

conducting a natural or artificial spun yarn made by and coming from a spun yarn machine and the at least one continuous filament through at least one yarn guide in parallel to enter a collector, wherein said collector is an enclosure box that surrounds at least one compressed air injection nozzle;

wherein an insert is placed in the at least one compressed air injector nozzle to create a plurality of interlaced points between said continuous filament and said spun yarn; and placing the at least one continuous filament and the natural or artificial spun yarn through the at least one compressed air injector nozzle to make points of interlacing between said continuous filament and said natural or artificial spun yarn to make a mixed yarn;

wherein said at least one compressed air injector nozzle further removes loosely attached molecules and fibers from said at least one continuous filament and the natural or artificial spun yarn;

wherein the molecules include oligomer molecules;

wherein the collector captures the loosely attached molecules and fibers from said at least one continuous filament and the natural or artificial spun yarn; and wherein the mixed yarn is wound on at least one winding packing bobbin.

2. The method of claim 1 wherein the at least one continuous filament is made of a material selected from the group consisting of recycled polyethylene terephthalate, polyester, biodegradable lactic polyacid plastic, biodegradable polyamide, biodegradable lyocell, biodegradable rayon, microbial cellulose, polyhydroxyalkanoate (PHA), cow manure cellulose, mushroom mycelium, animal protein cellulose, vegetal and fruit protein cellulose.

3. The method of claim 2 wherein the at least one continuous filament is a multi-component filament made of at least two raw materials.

4. The method of claim 1 wherein the natural or artificial spun yarn made by and coming from a spun yarn machine comprises at least one biodegradable yarn selected from the group consisting of cotton, organic cotton, viscose, lyocell, linen, hemp, and fibers from renewable natural raw material sources.

5. The method of claim 1 wherein each continuous filament of the at least one continuous filament receives a tension based on the elongation of each continuous filament.

6. The method of claim 1 wherein the compressed air pressure inside the at least one compressed air injection nozzle is between 0.3 and 6 bar.

7. The method of claim 1 further comprising removing the collector after capturing the plurality of molecules and fibers from said continuous filament and the natural or artificial spun yarn in order to clean the collector and dispose the plurality of molecules and fibers in a container.

8. The method of claim 7 wherein the collector is removed whenever there is a change of the winding packing bobbin.

9. The method of claim 1 wherein the spun yarn machine is selected from the group consisting of a vortex machine, a ring spun machine, and an open-ended machine.

* * * * *